US006182890B1

(12) United States Patent
Sattler et al.

(10) Patent No.: US 6,182,890 B1
(45) Date of Patent: Feb. 6, 2001

(54) COLLAPSIBLE CONTAINER FOR HOLDING FOODSTUFFS, AND METHODS OF USING SAME

(76) Inventors: Andrew J. Sattler, 1852 Yosemite, Birmingham, MI (US) 48009; Gregory A. Dimitroff, 43951 Cranberry Dr., Canton, MI (US) 48187

( * ) Notice: Under 35 U.S.C. 154(b), the term of this patent shall be extended for 0 days.

(21) Appl. No.: 09/393,843

(22) Filed: Sep. 10, 1999

(51) Int. Cl.[7] ..... B65D 3/00
(52) U.S. Cl. ..... 229/400; 229/104
(58) Field of Search ..... 229/104, 117.03, 229/117.05, 117.06, 400, 938; 206/541; 220/23.83

(56) References Cited

U.S. PATENT DOCUMENTS

| | | | | |
|---|---|---|---|---|
| D. 342,869 | | 1/1994 | Fry . | |
| D. 373,081 | | 8/1996 | Bridger . | |
| 2,149,612 | * | 3/1939 | Madsen | 220/23.83 |
| 2,740,576 | * | 4/1956 | Franck | 229/117.03 X |
| 3,845,897 | * | 11/1974 | Buttery | 229/104 X |
| 3,877,632 | * | 4/1975 | Steel | 229/104 |
| 4,185,764 | | 1/1980 | Cote . | |
| 4,410,129 | * | 10/1983 | Wischusen, III | 229/117.05 |
| 4,915,235 | | 4/1990 | Roosa . | |
| 5,358,175 | | 10/1994 | Cai . | |
| 5,417,364 | | 5/1995 | Shaw . | |
| 5,427,269 | | 6/1995 | Willbrandt . | |
| 5,429,262 | | 7/1995 | Sharkey . | |
| 5,433,337 | | 7/1995 | Willbrandt . | |
| 5,520,324 | | 5/1996 | Cai . | |
| 5,540,333 | | 7/1996 | Gonzalez et al. . | |
| 5,667,119 | | 9/1997 | Florence . | |
| 5,720,428 | | 2/1998 | Jensen . | |
| 5,875,957 | | 3/1999 | Yocum . | |

* cited by examiner

*Primary Examiner*—Byron P. Gehman
(74) *Attorney, Agent, or Firm*—Carrier, Blackman & Associates, P.C.; William D. Blackman; Joseph P. Carrier

(57) ABSTRACT

A collapsible, disposable food container includes a main body which is selectively adjustable between an operative, open position and a collapsed, flat position thereof. The container is constructed from a unitary piece of flat stock material folded to define front, back, side, and bottom walls. The container includes a main body having a bottom portion which is shaped substantially as a truncated cone, when the container is in its operative position, such that the bottom portion may be inserted in and stably engage the walls of a circular opening, such as a vehicle cup holder. Most preferably, the lower portion of the main body fits within a circular area 2.75 inches in diameter. In a preferred embodiment of the invention, each side wall includes an indentable gripping brace region, intermediate of upper and lower portions of the side wall, which can be flexed inwardly of the upper and lower portions of the side wall, when inwardly directed pressure is applied thereto. It is preferable that the indentable gripping brace regions be substantially football shaped. In an optional embodiment of the invention, the container further includes a secondary, body integrally formed with the main body, for holding auxiliary foodstuffs such as condiments. Where used, the secondary body defines a pocket connected to one of the front, back or side walls of the main body.

11 Claims, 15 Drawing Sheets

COLLAPSIBLE CONTAINER FOR HOLDING FOODSTUFFS, AND METHODS OF USING SAME

BACKGROUND OF THE INVENTION

1. Field of the Invention

The present invention relates to a collapsible, disposable container for holding foodstuffs, and more specifically to such a container which may be foldably assembled from a section of substantially rigid, flat stock material, which collapses flat for storage, and which easily expands to an open operable position for containing foodstuffs. More particularly, the present invention relates to such a container which is dimensioned, constructed and arranged to be stably insertable into a standard vehicle cup holder without deformation, which has an improved ergonomic design which may be easily gripped, and which may optionally include a smaller, secondary body for containing supplemental foodstuffs, such as condiments.

2. Description of the Relevant Art

Foodstuff containers are well known, with typical applications related to the fast food industry. There are many known foodstuffs containers which are made from a folded unitary piece of paperboard or other somewhat rigid flat material, such as disclosed in U.S. Pat. No. 5,520,324. These types of containers may additionally be made foldably collapsible for shipping, storage, or other purposes, such as disclosed in U.S. Pat. Nos. 4,185,764 and 5,720,428. However, the known foldably collapsible foodstuff containers are not able to be stably inserted into a standard vehicle cup holder without deformation, and do not have an ergonomic design allowing them to be easily gripped.

There are also many known containers having a circular base which will fit within a standard vehicle cup holder, such as disclosed in U.S. Pat. Nos. 5,358,175; 5,427,269; and 5,433,337. These containers are not collapsible for shipping or storage, and cannot be foldably assembled from a unitary flat piece of material.

Furthermore, there are many known collapsible foodstuffs containers which also have a secondary receptacle or other means for containing supplemental foodstuffs; such as condiments, or which support a supplemental foodstuffs container. Some such containers are disclosed in U.S. Pat. Nos. D373,081; 5,417,364; 5,540,333; and 5,875,957. These containers are not formed or folded from a unitary flat piece of material, but require additional processing to attach an additional wall, pocket, or other means to support or contain supplemental foodstuffs.

There are also known foodstuffs containers provided with a tear panel, which may be torn away to provide additional access to the foodstuffs, such as disclosed in U.S. Pat. No. 4,915,235, but they do not provide a tear panel which can be folded or otherwise formed into a supplemental foodstuffs container.

Although the known collapsible and disposable foodstuffs containers are effective for their intended purposes, there remains a need in the art for such a container which is simply constructed from a single, flat blank, but which may be easily fitted into a standard vehicle cup holder without substantial deformation, and which has an improved ergonomic design to allow for easy gripping thereof.

SUMMARY OF THE INVENTION

The present invention has been developed to overcome the foregoing limitations and disadvantages of conventional disposable containers for foodstuffs, and to generally fulfill a need in the art for a disposable, collapsible foodstuffs container which may be foldably assembled from a unitary piece of flat material, which is adapted to be stably inserted into a standard vehicle cup holder substantially without deformation, and which has an improved ergonomic design which may be easily gripped. Furthermore, in one particular embodiment thereof, the present invention fulfills a need in the art for a foodstuffs container of the type described which further has an optional, smaller, second body for containing supplemental foodstuffs, such as condiments.

According to the invention there is provided a collapsible, disposable food container, including a main body which is selectively adjustable between an operative, open position and a collapsed, flat position thereof. The container is constructed from a unitary piece of flat stock material folded and glued back on to itself to define front, back side, and bottom walls. Preferably, the bottom portion of the container is shaped substantially as a truncated cone when the main body is in the operative open position, such that the bottom portion may be inserted in, and stably engage the walls of a circular opening. Preferably, the lower portion of the container main body fits within a circular area in a range between 2.5 and 3 inches in diameter, and most preferably, 2.75 inches in diameter.

It is preferable that each of the side walls includes a support leg extending below the bottom wall for stably supporting the container on a flat surface. For additional support, it is preferable that the container includes overlapping panel sections extending from each of the side walls, respectively, and connected to portions of at least one of the front and back walls in an overlapping manner, and that the overlapping panel sections also have support legs extending below the bottom wall, which align with, and are connected to the side wall support legs.

For even further improved support on a flat surface, it is preferable that the bottom wall includes a front section, and a rear section which is wider than the front section, and that the front and rear sections of the bottom wall are non-symmetric to each other.

According to another preferred aspect of the invention, each side wall includes an indentable gripping brace region, intermediate of upper and lower portions of the side wall, wherein the indentable gripping brace region can be flexed inwardly of the upper and lower portions of the side walls, when inwardly directed pressure is applied thereto. It is preferable that the indentable gripping brace regions be made substantially football shaped.

In yet another aspect of the invention, the container further includes a smaller secondary body defining an auxiliary pocket which is integrally connected to one of the front, back or side walls of the main body, wherein the secondary body is also constructed from the unitary piece of flat stock material used to form the main body.

It is preferable that the container further include a horizontal contour relief slit defined through one of the front, back or side walls of the main body for nestingly receiving a tear-away portion of the container back wall therein during formation of the secondary body. Where used, the horizontal contour relief slit corresponds with and is located adjacent the secondary body.

Wherefore, it is an object of the present invention to provide a foodstuffs container which collapses flat for storage, which easily expands to an open position for containing foodstuffs, and which is adapted to be stably inserted into a standard vehicle cup holder without deformation.

It is a further object of the present invention to provide a foodstuffs container of the above-described type, which container may be foldably assembled from a unitary piece of flat material.

Another object of the present invention is to provide a foodstuffs container which may be foldably assembled from a unitary piece of flat material, which collapses flat for storage, which easily expands to an open position for containing foodstuffs, and which has an improved ergonomic design which may be easily gripped.

It is yet a further object of the invention to provide a foodstuffs container which may be foldably assembled from a unitary piece of flat material, which collapses flat for storage, which easily expands to an open position for containing foodstuffs, and which includes an optional, smaller, secondary body for containing supplemental foodstuffs, such as condiments.

For a more complete understanding of the present invention, the reader is referred to the following detailed description section, which should be read in conjunction with the accompanying drawings. Throughout the following detailed description and in the drawings, like numbers refer to like parts.

DETAILED DESCRIPTION OF THE PRESENTLY PREFERRED EMBODIMENTS

Overview

Figure 1:
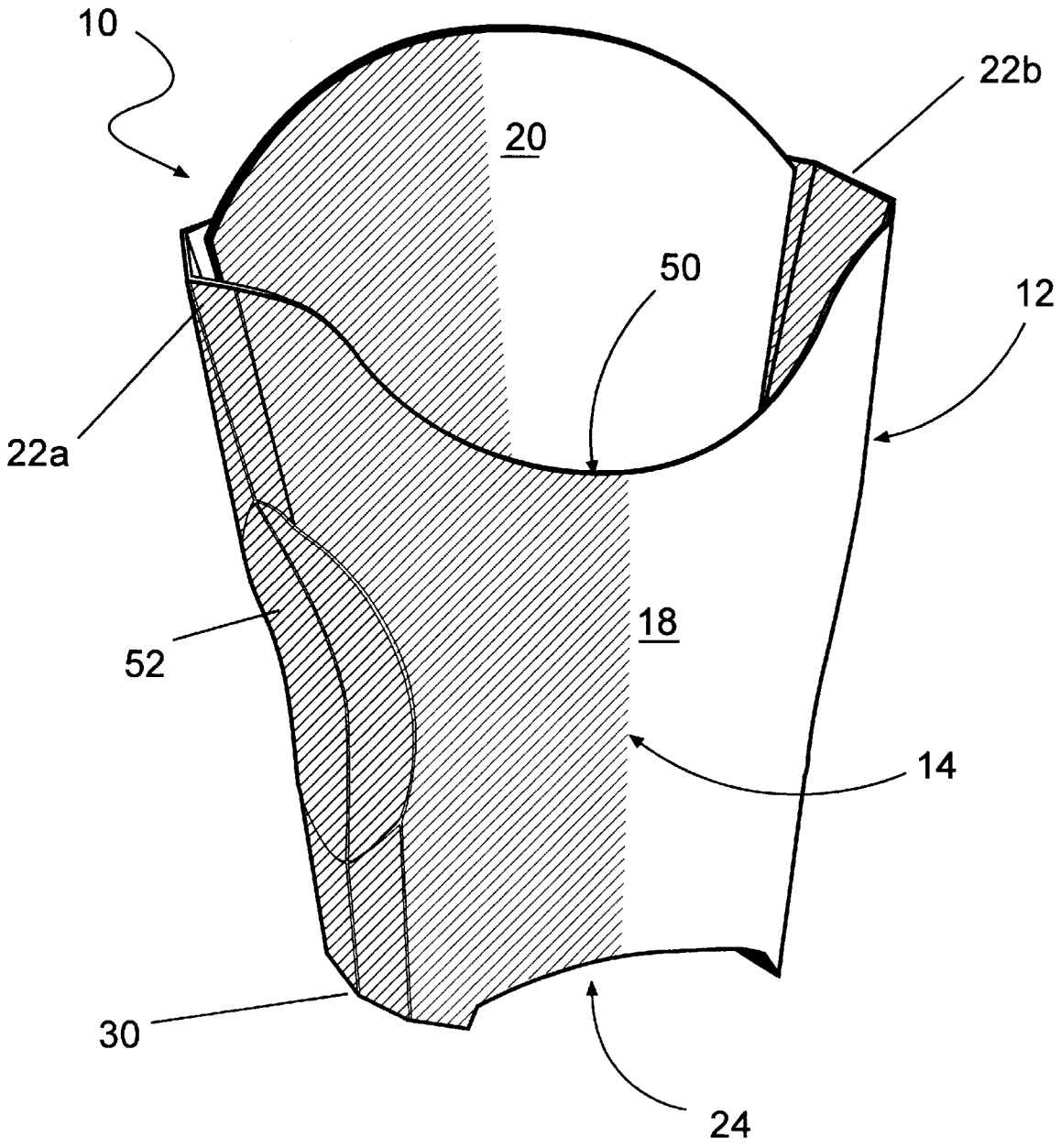
FIG. 1 is a front perspective view of a collapsible, disposable food container in accordance with a first preferred embodiment of the present invention, shown in an open configuration thereof.
Figure 2:
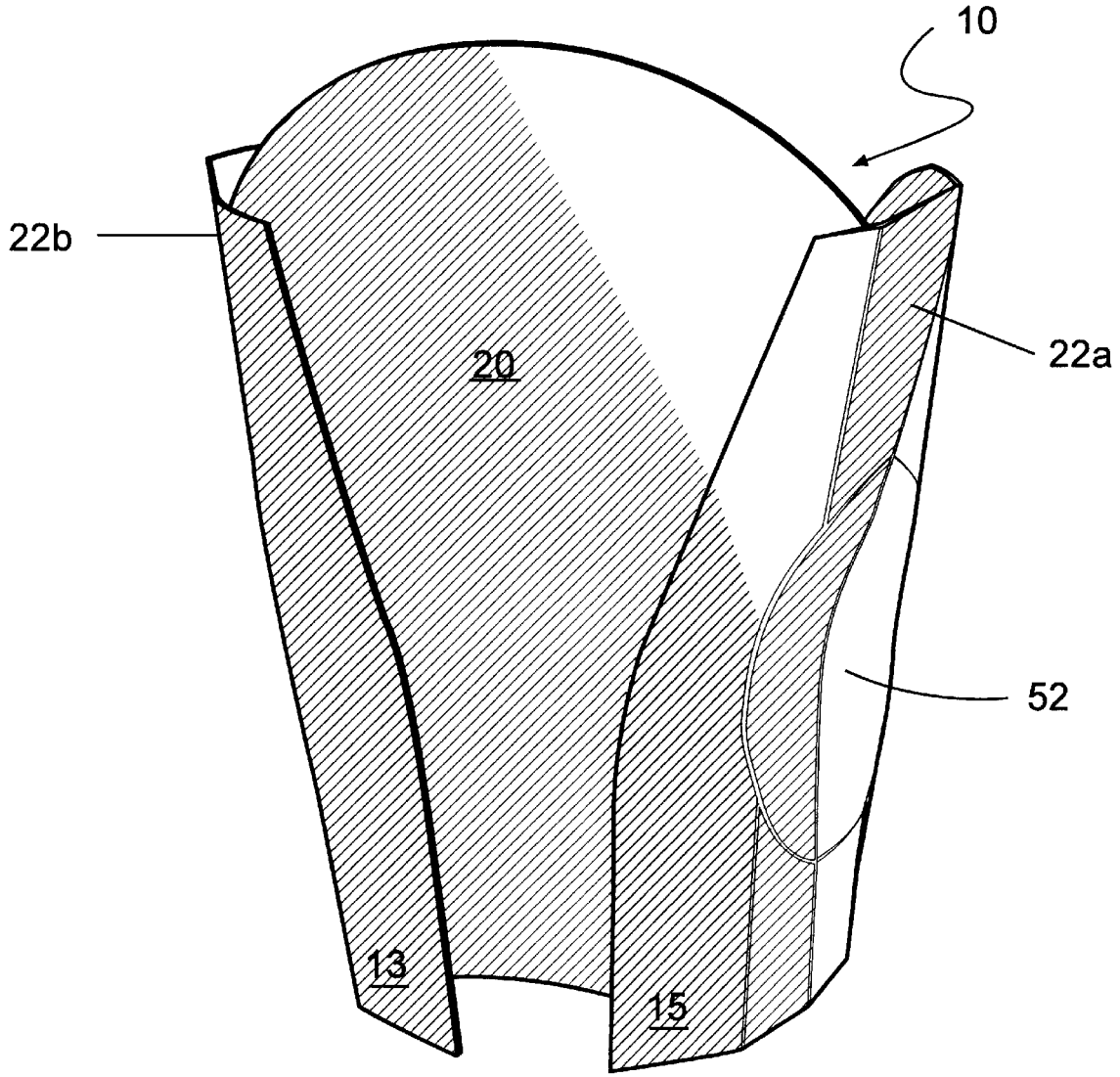
FIG. 2 is a rear perspective view of the collapsible, disposable food container of FIG. 1, in accordance with the first preferred embodiment of the present invention.

Referring to FIGS. 1–2, there is shown an open configuration of a collapsible, disposable food container 10 according to a first preferred embodiment of the invention. The food container 10 generally includes a main body 12, which includes a bottom portion 14 for engaging the walls of a circular opening. The main body 12 is selectively adjustable between the operative, open position of FIGS. 1–2 and a collapsed, flat position shown in FIG. 3. The main body 12 is generally constructed out of a unitary piece of flat stock material 16 (FIG. 4) which is folded and glued back on itself to define a plurality of container walls, which surround and define a primary pocket 50 therein for receiving and holding a foodstuff, such as, for example, french fries or onion rings. Each of these components, walls, and sections of the food container 10 will be discussed in greater detail hereinbelow.

Flat Stock Material

Figure 4:
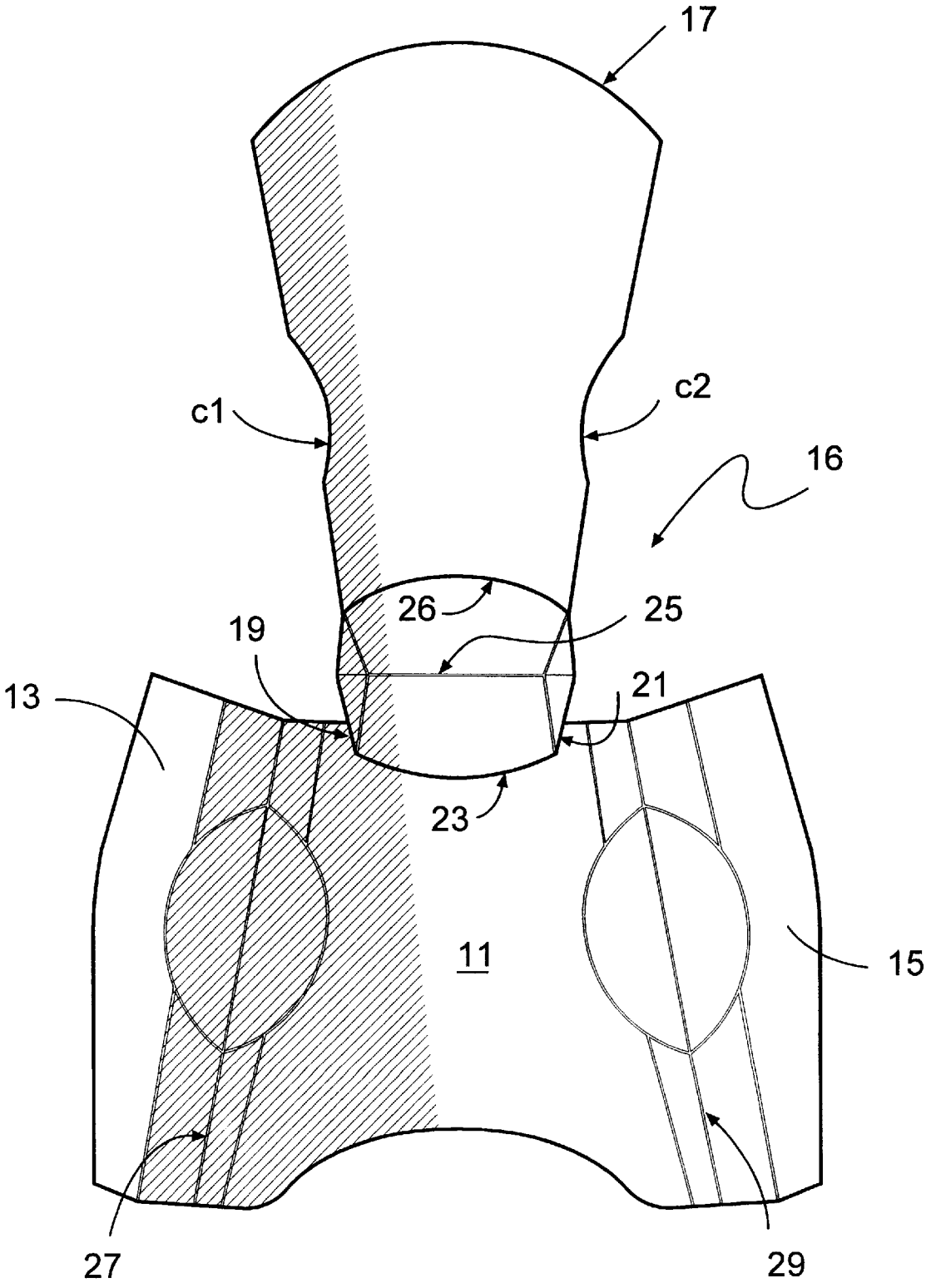
FIG. 4 is a plan view of a flat sheet of stock material which is suitable to be foldably assembled into the collapsible, disposable food container in accordance with the first preferred embodiment of the present invention.

Referring specifically to FIG. 4, the unitary piece of flat stock material 16 is preferably constructed of paperboard common to the industry, but may be constructed of thin plastic or other flat material. The flat stock material 16 is generally stamped and printed with indented score lines, when manufactured, to aid in the folding necessary to form the food container 10.

The flat stock material 16 is made in an inverted T-shape, as shown, and generally includes a wide base portion 11, having a pair of opposed outer side flanges 13, 15 at the outermost side portions thereof, and a narrow upper section 17 which is integrally attached to top central part of the base portion 11. A pair of opposed arcuate medial cutouts, designated in the drawing as C1 and C2, are formed in opposite side edges of the narrow upper section 17.

Although the base portion 11 and the upper section 17 are referred to in the above-identified terms for convenience and ease of description, these terms are used for purposes of illustration, and are not intended to be limiting. It will be understood that the flat stock material 16 could be inverted to form an upright T-shape in which the relative upper and lower positions are reversed, without changing the usefulness or function thereof.

A die typically stamps the necessary shape for the flat stock material 16 multiple times out of a large sheet of paperboard, and often from stacked layers of paperboard sheets, to produce multiple pieces of substantially identical flat stock material 16. Any perforations, indentations, cut lines and/or bend creases are generally stamped therein at the same time and in the same stamping operation. The flat stock material 16 may, however, be formed using other mechanisms such as a laser cutter or conventional cutter, and could easily be formed one at a time, if desired.

Each of the dashed lines in FIG. 4 represents a scored indentation formed in the flat stock material 16, in the first preferred embodiment hereof Also in the first preferred embodiment hereof, the flat stock material 16 is cut therethrough in two places to form first and second cut lines 19, 21, which extend along the solid lines in the drawing from opposed bottom edges of the narrow upper section 17 where it joins with the base portion 11, downwardly through the flat stock material to opposite ends of a curved horizontal indentation 23 at the upper center of the base portion.

Since the present invention is formed from a unitary piece of flat stock material 16, it is well suited for inexpensive mass production.

Forming the Container from the Flat Stock Material

After the flat stock material 16 is has been made, a folding and gluing operation is necessary to transform it into the container 10. Folding machines are common to the industry to fold and form disposable containers, but the container 10 could easily be foldably assembled in a manual operation, if so desired.

In forming the container 10, the base portion 11 is folded over behind the narrow upper section 17 along the flat horizontal fold line 25 near the bottom of the narrow upper section. Then, a suitable adhesive is applied to the exposed surfaces of the outer side flanges 13, 15, and the outside edges of the base portion 11 are folded inwardly along respective substantially vertical fold lines 27, 29, until the outer side flanges overlap and contact the side edges of the narrow upper section 17. The substantially vertical fold lines 27, 29 are not strictly vertical, but rather, diverge outwardly from the bottom to the top thereof, as shown, so as to define an angle therebetween. The adhesive on the outer side flanges 13, 15 causes them to adhere on to the narrow upper section 17 to form the main body 12 of the container 10, which is initially in the flattened, closed configuration shown in FIG. 3, which is the preferred configuration of the container 10 for shipping and storage.

The container 10 may be placed into its open position by pressing inwardly on opposite side edges 40 thereof, and by simultaneously pressing upwardly on the horizontal fold line 25 at the bottom thereof. When this upward pressure is applied to the bottom of the container 10, the flat stock material 16 separates along the first and second cut lines 19, 21 so that an elevated bottom wall 24 may be formed, simultaneously defining a pair of opposed side support legs 30 extending below the bottom wall 24.

Pressing inwardly on the side edges 40 of the flat container may cause a football shaped indentable gripping brace region 52 to be formed in each of the side walls 22*a*, 22*b*, as will be outlined in further detail below.

As used throughout the specification and in the claims, the term football shaped is intended to be consistent with the commonly understood meaning of the term, and refers to a generally oval shape, which is modified from a standard oval to be made substantially pointed at each of two opposite ends thereof, as shown particularly on the base portion 11 of the flat stock material 16 in FIG. 4. In other words, a football shape is a substantially two-dimensional shape which includes first and second convex side edges, which intersect one another to define first and second end points, as shown in FIG. 4.

Once folded into its assembled configuration, the container 10 is preferably maintained by means of an adhesive placed between the inside of the outer side flanges 13, 15 and the outside of the back wall 20; however, other means could be used to maintain the fold, such as a hook type configuration on the outer side flanges 13, 15 engaging corresponding slots on a wall such as the back wall 20. Also, the container could be designed such that the overlapping outer side flanges 13, 15 were located elsewhere on the container 10, and overlapped different walls.

Figure 3:
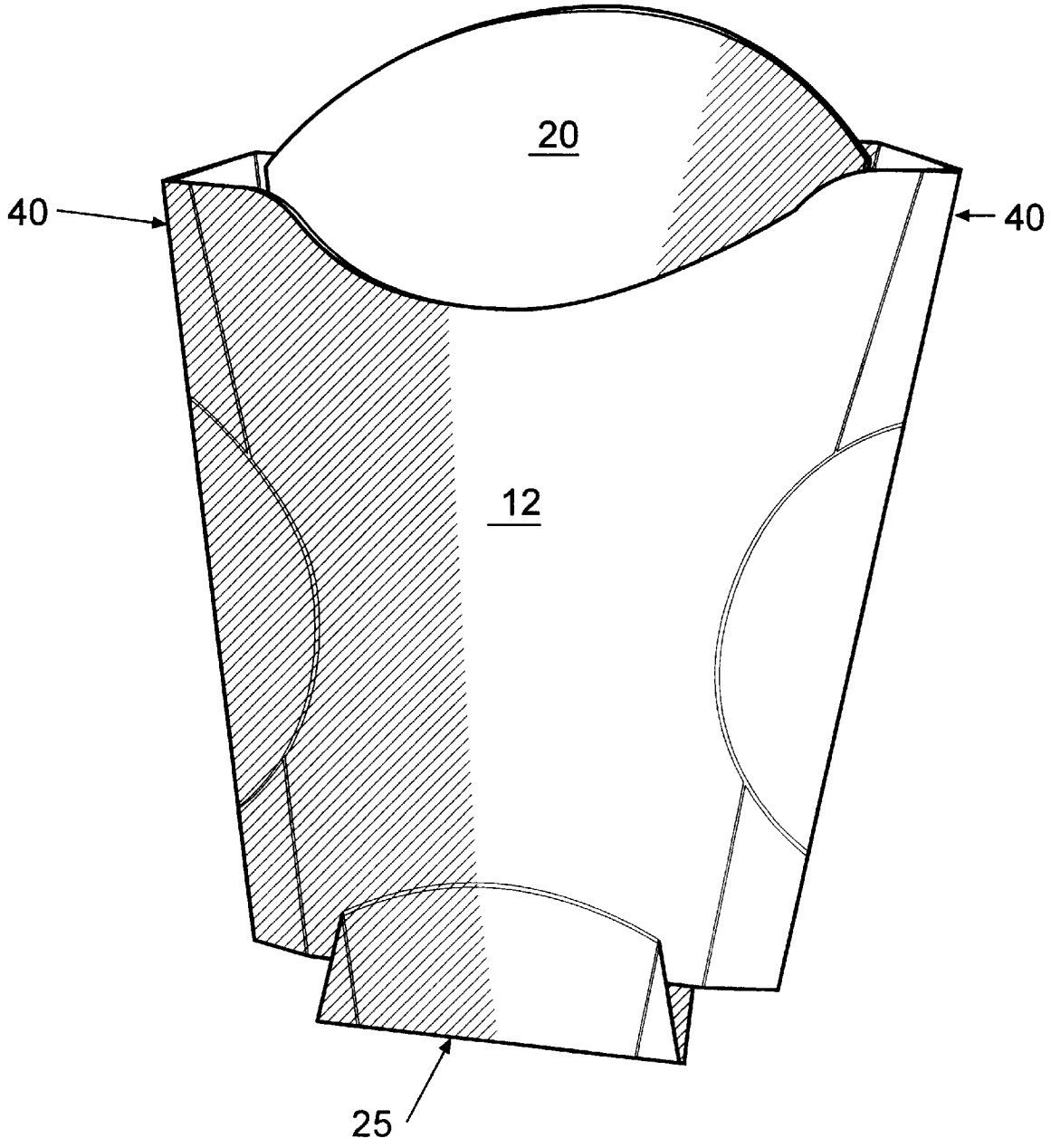
FIG. 3 is a front perspective view of the collapsible, disposable food container of FIGS. 1–2, in accordance with the first preferred embodiment of the present invention, shown in a partially closed configuration thereof.

After the the fold is maintained, the container 10 is generally collapsed flat for shipping and storage, as shown in FIG. 3. The general conical shape of the container 10, enables multiple containers to be placed inside one another, either in the collapsed or in the open state, thus allowing the containers to be stacked in columns or to be dispensed from a dispenser similar to those presently used to dispense disposable drink containers at fast food restaurants and convenience markets.

The Main Body

Figure 5:
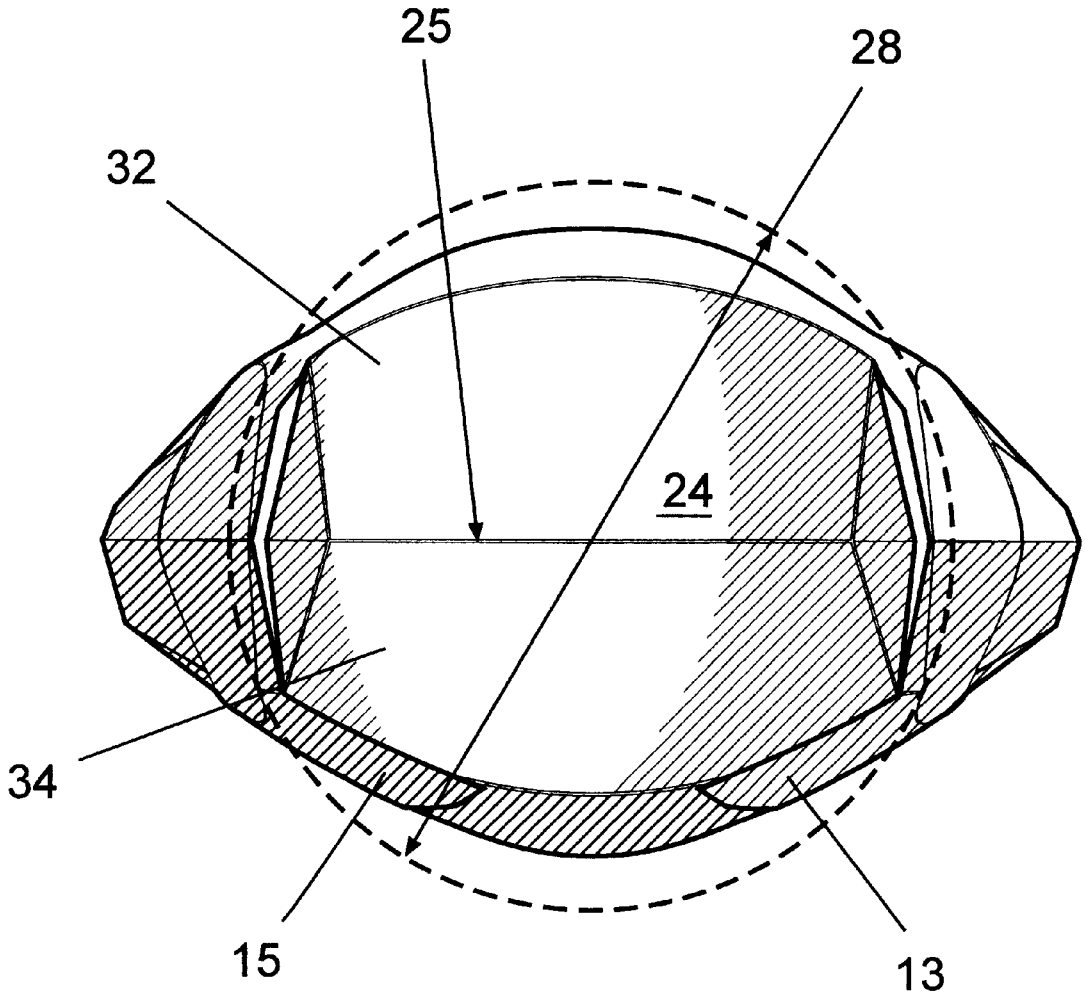
FIG. 5 is a bottom plan view of the collapsible, disposable food container of FIGS. 1–2, in accordance with the first preferred embodiment of the present invention.

Referring specifically to FIGS. 1, 2, & 5, the main body 12, when in the open position, defines a front wall 18, a back wall 20, a pair of opposed side walls 22*a* and 22*b*, and a bottom wall 24. The front wall 18 and the back wall 20 are substantially vertically opposed to one another, but instead of being parallel to one another, they diverge outwardly away from one another as they extend upwardly away from the bottom wall 24. As noted, the front, back, side, and bottom walls 18, 20, 22, 24 together surround and define a primary pocket 50 therebetween for holding a foodstuff.

Each side wall 22*a*, 22*b* is vertically interposed between the front wall 18 and the back wall 20 in an orientation substantially perpendicular to the front wall 18 and the back wall 20, and connects to corresponding side edges thereof. In a manner similar to the front and back walls 18, 20, the side walls 22*a*, 22*b* are substantially vertically opposed to one another, but instead of being parallel to one another, they diverge outwardly away from one another as they extend upwardly away from the bottom wall 24. Most preferably, the side walls 22*a*, 22*b* define an angle therebetween of about 15–25 degrees, which is similar to the angle formed between opposed side walls of a vehicle cup holder (not shown).

It will be understood from the foregoing discussion that when the container 10 hereof is in its open position as shown in FIG. 1, taken together, the front, back and side walls 18, 20, 22*a*, 22*b* define a truncated, generally conical shape which is larger at the top than at the bottom thereof.

The bottom wall 24 is preferably only connected to the bottom side of the front wall 18 and the back wall 20, but could be designed to connect to the side walls 22*a*, 22*b* as well.

The front 18 and back 20 walls are wider than the side walls 22*a*, 22*b*, and the side walls 22*a*, 22*b* are substantially equal to each other in width, such that the front profile of the main body 12 is larger than the side profile thereof. The front wall 18, back wall 20, and side walls 22*a*, 22*b* are each outwardly convex, as viewed from the outside of the container, so that any horizontal cross-section of the main body 12 is generally rounded in shape, with the exception of the optional centrally indented concave braces 52 in the side walls, where used. Moving from the top open portion of the container to the bottom portion 14, the main body 12 tapers down such that the horizontal cross sectional area thereof, substantially parallel with the bottom wall 24, continually decreases and the main body 12 is generally conical in shape, as previously noted.

Each side wall 22*a*, 22*b* of the main body 12 generally includes an integrally formed side support leg 30 at its lowermost portion, extending below the bottom wall 24 for stably supporting the food container 10 on a flat surface. Preferably, in the open configuration of the container 10, the lower edges of both of the side support legs are substantially flat, and taken together, define a plane, allowing for stable placement of the container 10 on a flat surface such as a tabletop.

In an equivalent design for the container (not shown), each support leg 30 could alternatively be formed at an intersection between each side wall 22*a*, 22*b* and the bottom wall 24.

Referring specifically to FIG. 5, the bottom wall 24 of the food container 10 generally includes a front section 32, and a rear section 34 separated from the front section 32 by a bend line 25, along which the bottom wall is collapsible. Preferably, the front 32 and rear 34 sections of the bottom wall 24 are non-symmetric to one another. Although both sections 32, 34 may be made symmetric to one another, in the preferred embodiment of the invention, it is desirable that the rear section 34 be wider than, and extend beyond the front section 32, to provide improved support and prevent the container 10 from tipping rearward. This is significant since many similar containers tend to tip rearwardly when a consumer reaches for foodstuffs housed therein.

Although the bottom wall 24 is substantially perpendicular to the side 22*a*, 22*b*, front 18, and rear 20 walls in a general sense, the bottom wall 24 is preferred to be generally bowed upwardly in the open configuration of the container 10, so as to be concave from side to side, as viewed from the bottom. The outwardly concave shape of the bottom wall 24 allows the bottom wall 24 to snap into position when the container 10 moves from a flat, folded configuration, to an open, operable configuration, and to retain such an open position. The concave shape of the bottom wall is a result of curved fold lines 23, 26 (FIG. 4) defining the outside borders of the bottom wall. These curved fold lines 23, 26 also help to form rounded surfaces of the front and back walls 18, 20 when the container 10 is in the open position, contributing to the conical shape thereof.

As shown in FIGS. 2 & 5, the main body 12 also generally includes the outer side flanges 13, 15 extending from the side walls 22*a*, 22*b*, respectively, and connected to portions of the back wall 20 in an overlapping manner.

In a different but equivalent embodiment (not shown), the overlapping portions could alternatively extend such that they may be attached to the front wall 18, or even to both the front wall 18 and the back wall 20.

The overlapping panels formed by the outer side flanges 13, 15 also include support legs at the bottom portions thereof which are integral with the side support legs 30 of the side walls 22*a*, 22*b* and extend below the bottom wall 24 to provide additional support for the container 10 on a flat surface. Each of the support legs preferably extends approximately one-third of the way around the back wall 20 or more, to provide support for the container 10, when filled with a foodstuff and oriented vertically on a flat surface .

The Bottom Portion of the Container

Referring specifically to FIGS. 1 & 5, the bottom portion 14 of the main body 12, roughly including an area from the bottom third to the bottom half of the container 10, is shaped substantially as a truncated cone when the main body 12 is in an open, operative position. The bottom wall 24 acts approximately as a plane cutting through the generally conical shape of the main body 12 in a substantially horizontal orientation, although as noted, the bottom wall 24 is preferred to be made outwardly concave in the preferred embodiment. At any rate, the bottom portion 14 does not entirely form a cone because it does not come to a point at the very bottom thereof, but rather, forms a truncated cone.

The reason that bottom portion 14 is shaped substantially as a truncated cone is so that the bottom portion 14 may be inserted in, and stably engage the walls of a circular opening 28 (FIG. 5). The diameter of the circular opening 28 is typically in a range of about 2.5 to 3 inches, and most preferably, about 2.75 inches, corresponding with the diameter of most standard vehicle cup holders in use in vehicles on the road today; however it may be larger or smaller to accommodate various holders, as desired. Moreover, since the bottom portion 14 of the container 10 is conically tapered, as previously noted, it will fit into circular openings in a range of sizes, and will then sink down in the circular opening 28, until it rests at a point on the container where the size thereof equals the size of the opening, provided that the circular opening is not wider than the top of the container.

Operation and Use of the Container

The container 10 collapses by bending outwardly along side wall fold lines 27, 29 which are substantially vertically oriented along the intermediate vertical portion of the side walls 22*a*, 22*b*, and along the bottom wall bend line 25.

The container 10 is placed into an open, operable position by flexing inwardly upon the outermost edges 40 of the side walls 22*a*, 22*b*, or otherwise generally pulling the front wall 18 away from the back wall 20, and then applying force upwardly upon the bend line 25 of the bottom wall 24, until the bottom wall 24 snaps upward into a concave shape. The concave shape of the bottom wall 24 from side to side tends to keep the bend line 25 from bending out of the open configuration, which also keeps the front wall 18 and the back wall 20 separated by the snapped in place bottom wall 24, and thus maintains the open, operable configuration of the container 10.

As previously noted, each side wall 22*a*, 22*b* of the main body 12 may include an indentable gripping brace region 52. The indentable gripping brace region 52 is approximately medially located on the respective side wall 22*a*, 22*b*, and the indentable gripping brace region 52 can be flexed inwardly of the upper and lower portions of the corresponding side wall when inwardly directed pressure is applied thereto.

The indentable gripping brace regions 52 are substantially football shaped to provide improved ergonomic gripping of the food container 10, as well as design appeal and improved retention in a tall vehicle cup holder or other retainer. Moreover, the football shape, with its outer arcuate side edges, has the further advantage that when the gripping brace region 52 is pressed inwardly, it aligns with, and is reinforcingly supported by, the respective arcuate medial cutout C1 or C2, on the narrow upper section 17 of the flat stock material 16 making up the container 10.

The brace regions 52 are indentable, thus making their use optional, in the event the full volume of the container 10 is needed. In order to make brace regions 52 easily indentable and predefined, they are each preferably described by a perforated line about their perimeter; although, fold lines, indented score lines, or other methods of marking such a region are also appropriate.

Indenting the brace regions 52 has the effect of reducing the horizontal cross sectional area of the container 10 in those areas. The brace regions 52 further improve the stability of the container 10 when indented, by bracing the side walls 22*a*, 22*b* and thereby temporarily and disengagably locking the container 10 in an open position, and reducing the possibility of the container 10 collapsing during use.

Indentable brace regions 52 can be included in the design of such food containers at almost no additional cost. If a die is used to cut the initial flat stock material 16, then perforated lines or fold lines defining the brace regions 52 may be included in the design of the die. As such, the brace regions 52 are an option that may or may not be used, simply by chosing whether or not to indent the brace regions in a particular application thereof.

The Second Preferred Embodiment

Referring to FIGS. 6–12, there is shown a collapsible, disposable food container 110 according to the second preferred embodiment. The second preferred embodiment is substantially similar to the first embodiment 10 as described herein, with the further addition that the container 110 according to this embodiment may, optionally, include a horizontal contour relief slit 108 (FIG. 8), and includes a smaller, secondary body 104 attached to the main body 112 and defining an auxiliary pocket 106. The second preferred embodiment, as shown, may also include indentable brace regions 152 in the side walls 122 thereof, as in the first preferred embodiment, but these brace regions are entirely optional.

The secondary body 104 defines an auxiliary pocket 106 for holding a secondary foodstuff, such as a condiment. The secondary body 104 preferably connects to, and is foldably formed from the back wall 120; although, it could also be connected to and formed from one of the front 118 or side walls 122 of the main body 112. Being formed from the back wall 120, the secondary body 104 is thereby integrally constructed from the unitary piece of flat stock material 116, together with the main body 112.

Figure 8:
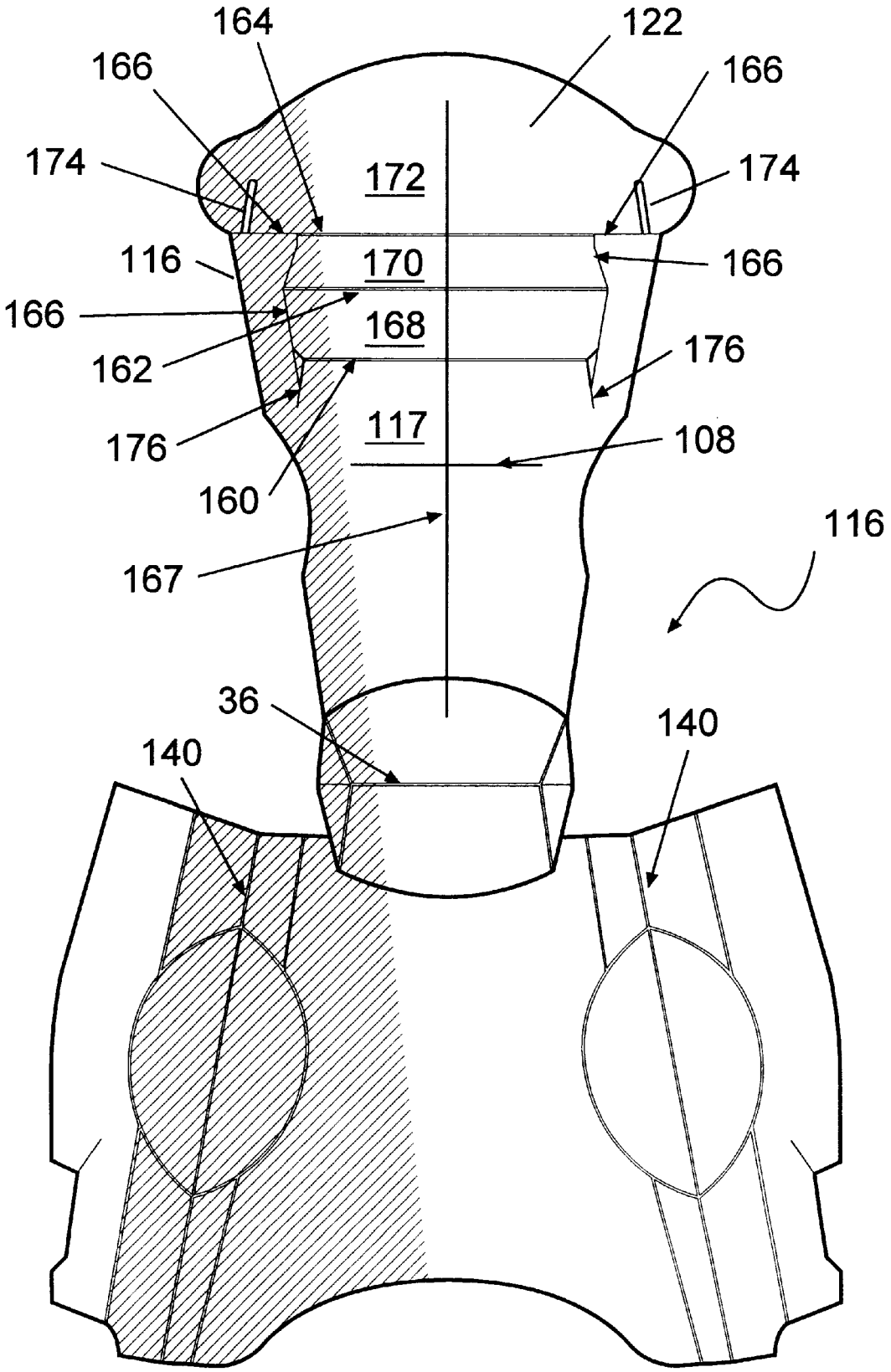
FIG. 8 is a plan view of a flat sheet of stock material which is suitable to be foldably assembled into the collapsible, disposable food container in accordance with the second preferred embodiment of the present invention.
Figure 9:
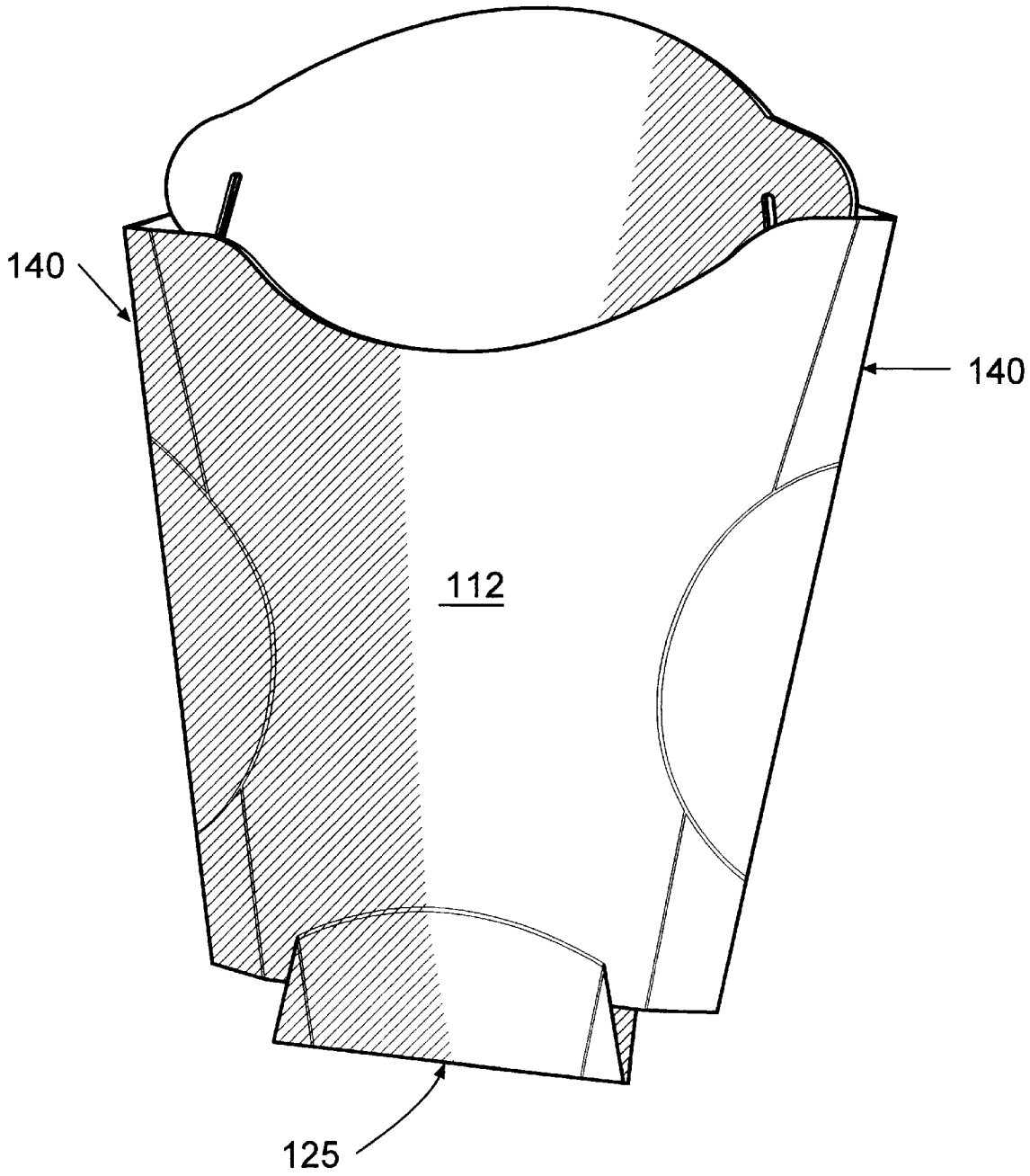
FIG. 9 is a front plan view of the collapsible, disposable food container of FIGS. 6–7, in accordance with the second preferred embodiment of the present invention, shown in a fully collapsed configuration therof, and before a secondary body has been foldably assembled thereon.
Figure 10:
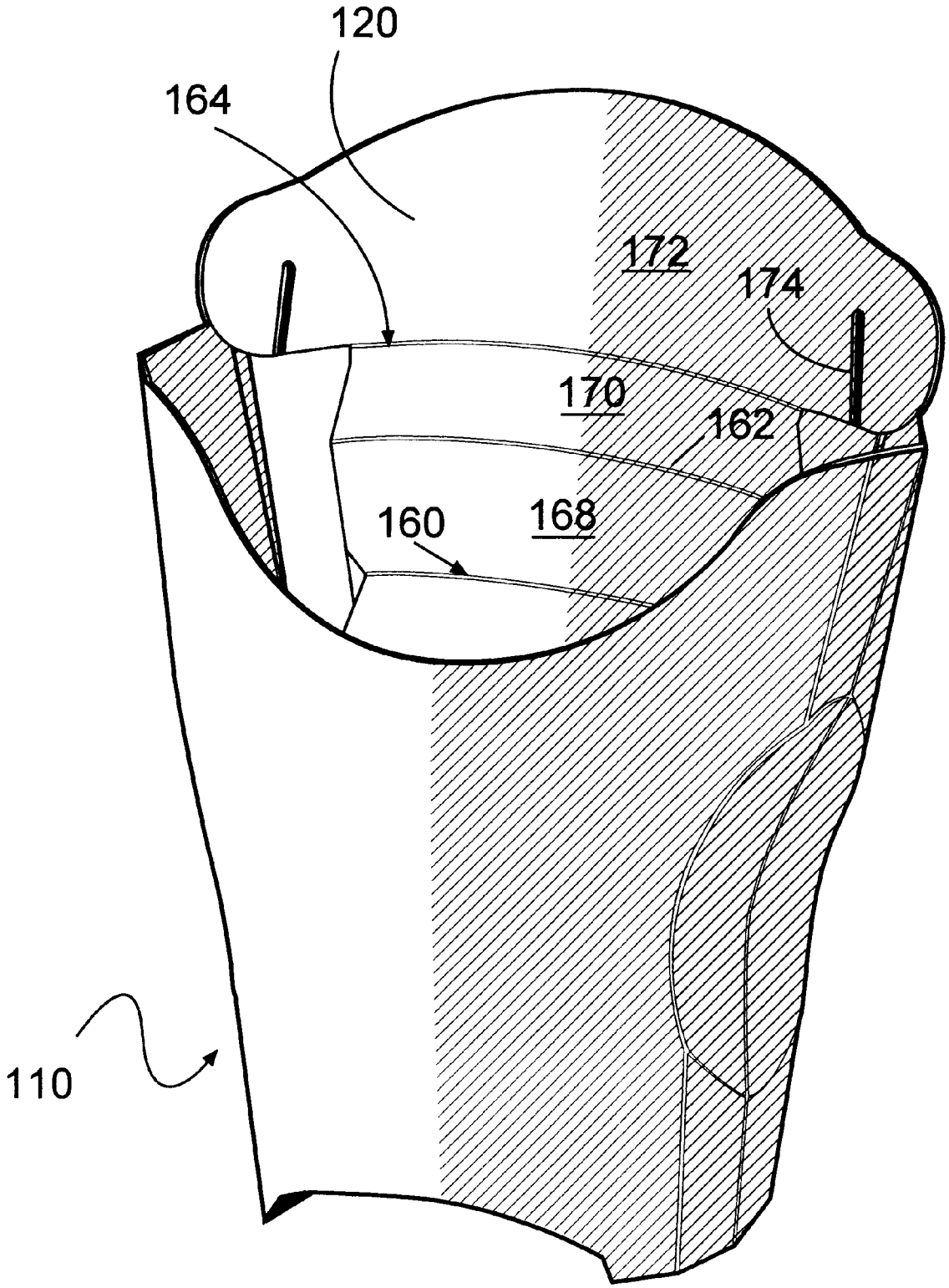
FIG. 10 a rear perspective view of the collapsible, disposable food container of FIGS. 6–7, in accordance with a second preferred embodiment of the present invention, before a secondary body has been foldably assembled thereon.
Figure 11:
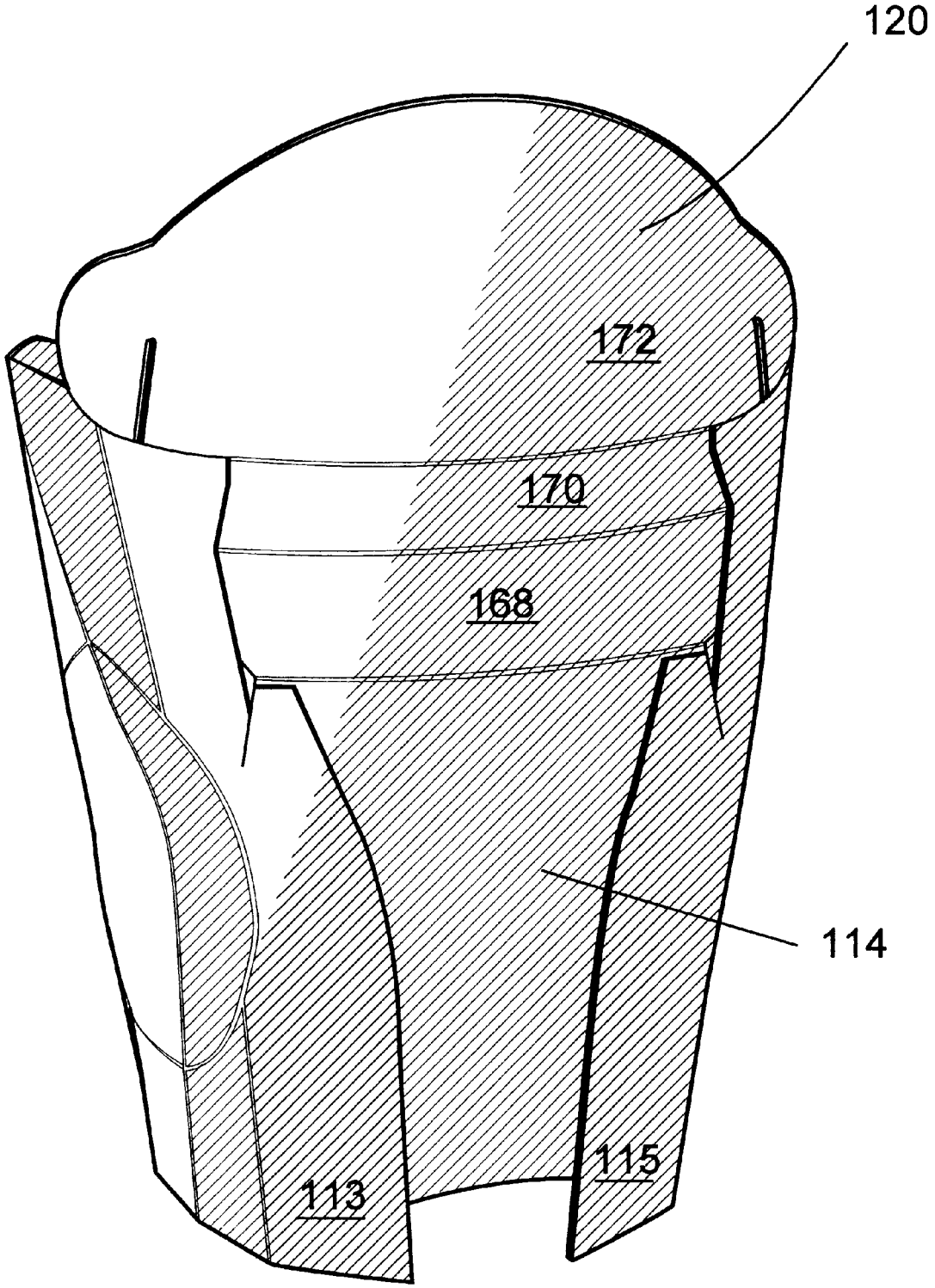
FIG. 11 is a rear perspective view of the collapsible, disposable food container of FIGS. 6–7, in accordance with a second preferred embodiment of the present invention, before a secondary body has been foldably assembled thereon.

Referring specifically to FIG. 8, the area 122 (shown shaded in the drawing), which when folded forms the secondary body 104, is defined along the narrow upper section 117 of the flat stock material 116 by three fold lines 160, 162, 164, two perforated tear-away lines 166, and the outer side edges of the narrow upper section 117. It further includes three sections 168, 170, 172 and a means for retaining the folded configuration which forms the secondary body 104.

The first fold line 160, which is the lowermost of the three fold lines, runs horizontally along the upper portion of the narrow upper section 117, substantially parallel with the bottom wall fold line 125. The second fold line 162 also runs horizontally along the upper portion of the narrow upper section 117, above and parallel with the first fold line 160. The third fold line 164 runs horizontally along the narrow upper section 117, above and parallel with the second fold line 162.

The two perforated tear-away lines 166 are symmetrical to one another about an imaginary vertical center line 167 of the narrow upper section 117, in the area which forms back wall 120. Together, the perforated lines 166 define the side edges of the secondary body 104. Each perforated line 166 runs substantially vertically up the back wall 120 from a point below the corresponding endpoint of the first fold line 160, past the corresponding endpoint of the second fold line 162, to the corresponding endpoint of the third fold line 164. From the corresponding endpoint of the third fold line 164, each perforated line 166 runs horizontally outward, in line with the third fold line 164, until it meets the corresponding outer edge of the narrow upper section 117. The area of material 122 forming the secondary body 104 is described within an area bounded by the first fold line 160, the two perforated lines 166, and the outer side edges of the narrow upper section 117 where it forms the back wall 120.

The first subsection 168 of the secondary body 104 is located between the first fold line 160, and the second fold line 162. The second subsection 170 is located between the second fold line 179, and the third fold line 164. The third subsection 172 is located between the third fold line 172 and the upper edge of the back wall 120. The third subsection 172 includes a means for retaining the folded configuration which forms the secondary body 104.

The means for retaining the folded configuration includes a pair of connecting slots 174 through the third subsection 172, oriented substantially perpendicular to the third fold line 164. Each slot 174 intersects the horizontal portion of the corresponding perforated line 166 at one end, and ends at an intermediate point within the third subsection 172. The portions of the perforated lines 166 below the first fold line 160, constitute a pair of receiving slots 176 which correspond to the connecting slots 174, and affixedly receive them.

Preferably, the container 110 further includes a horizontal contour relief slit 108 defined through the back wall 120 of the main body; the slit corresponding with and located below the first fold line 160. Where used, the horizontal contour relief slit allows the upper portion of the container 110 to assume its own shape independently of the bottom section 114.

Figure 6:
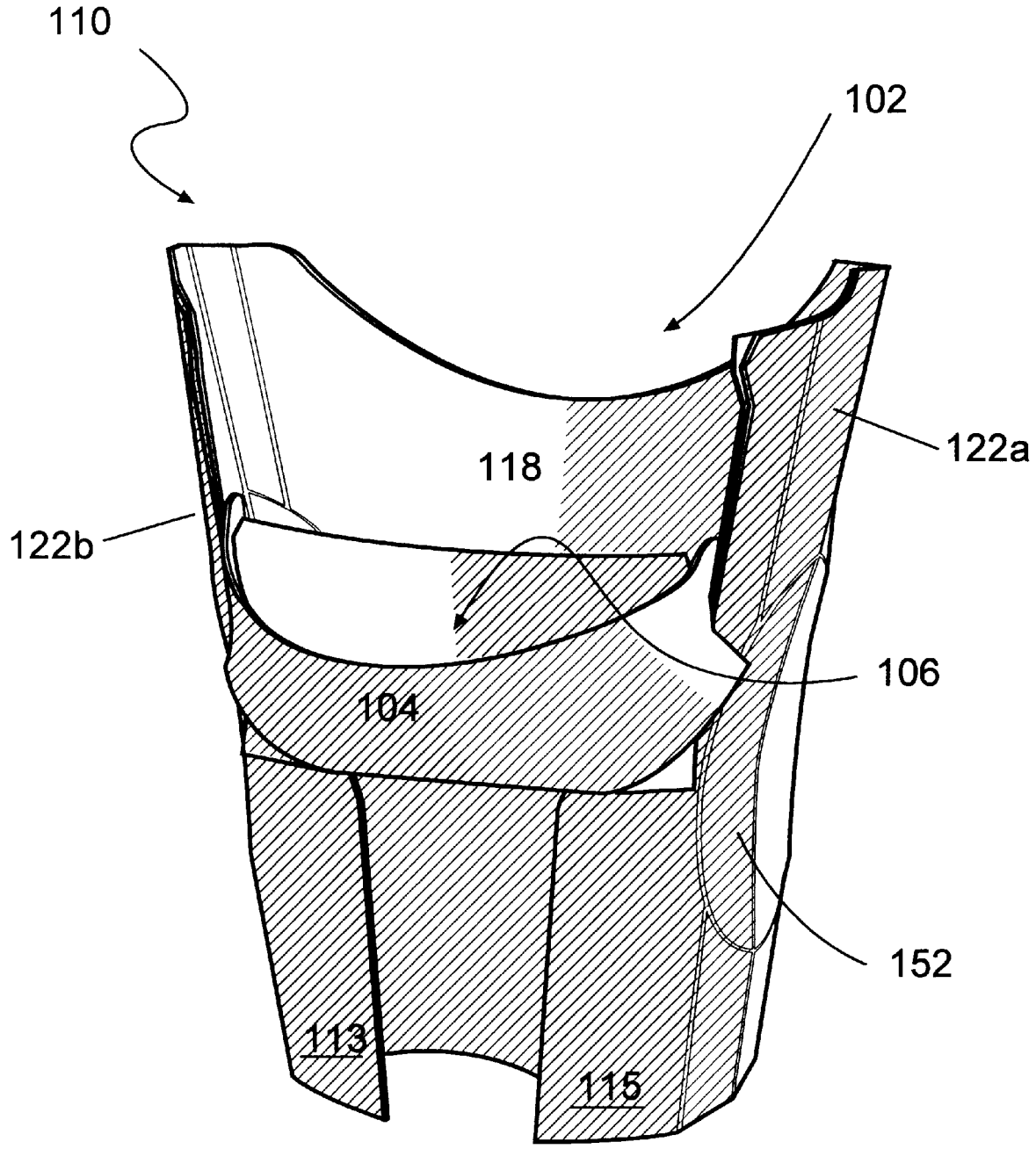
FIG. 6 is a rear perspective view of a collapsible, disposable food container in accordance with a second preferred embodiment of the present invention.
Figure 7:
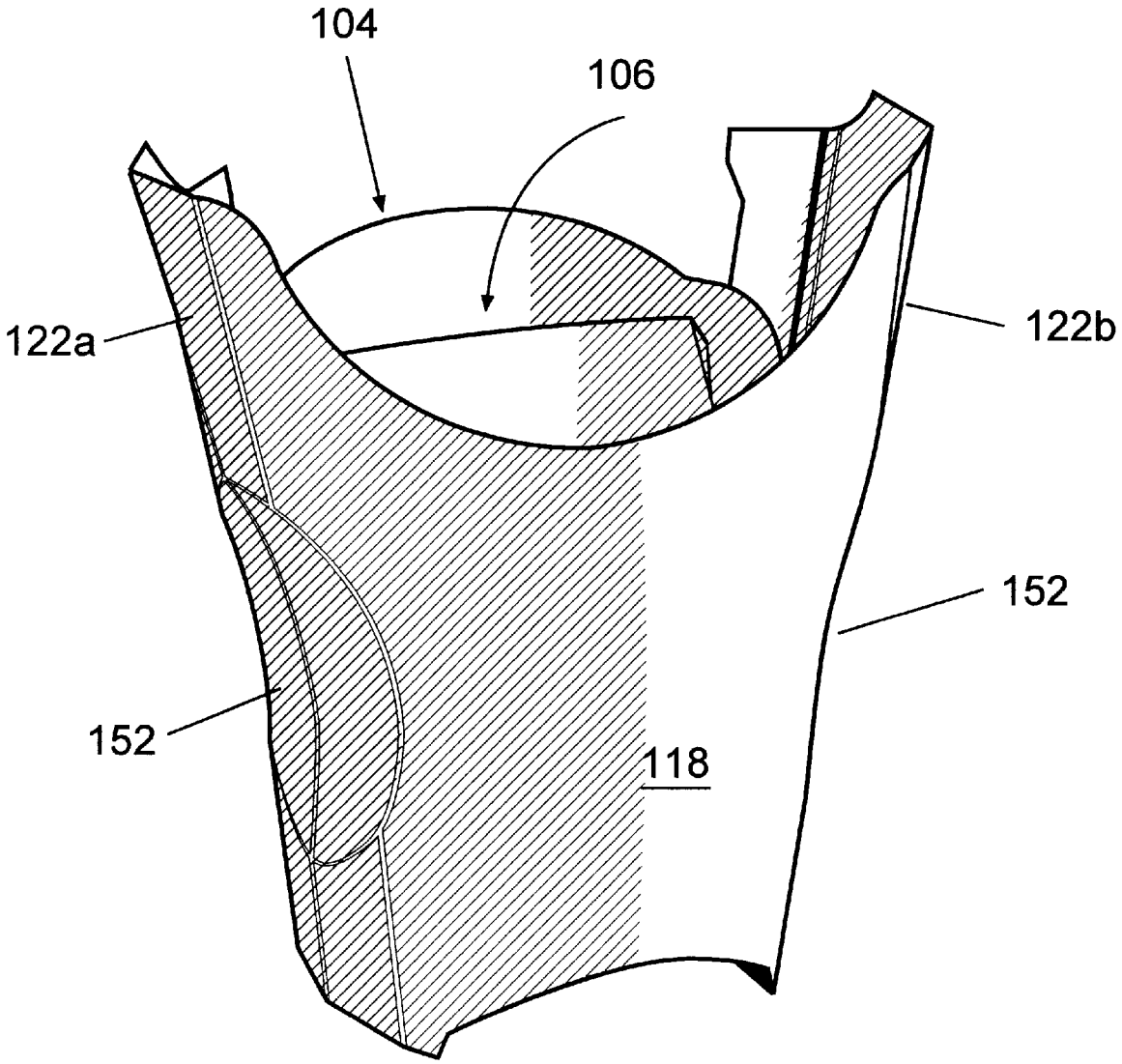
FIG. 7 is a front perspective view of the collapsible, disposable food container of FIG. 6, in accordance with the second preferred embodiment of the present invention.
Figure 12:
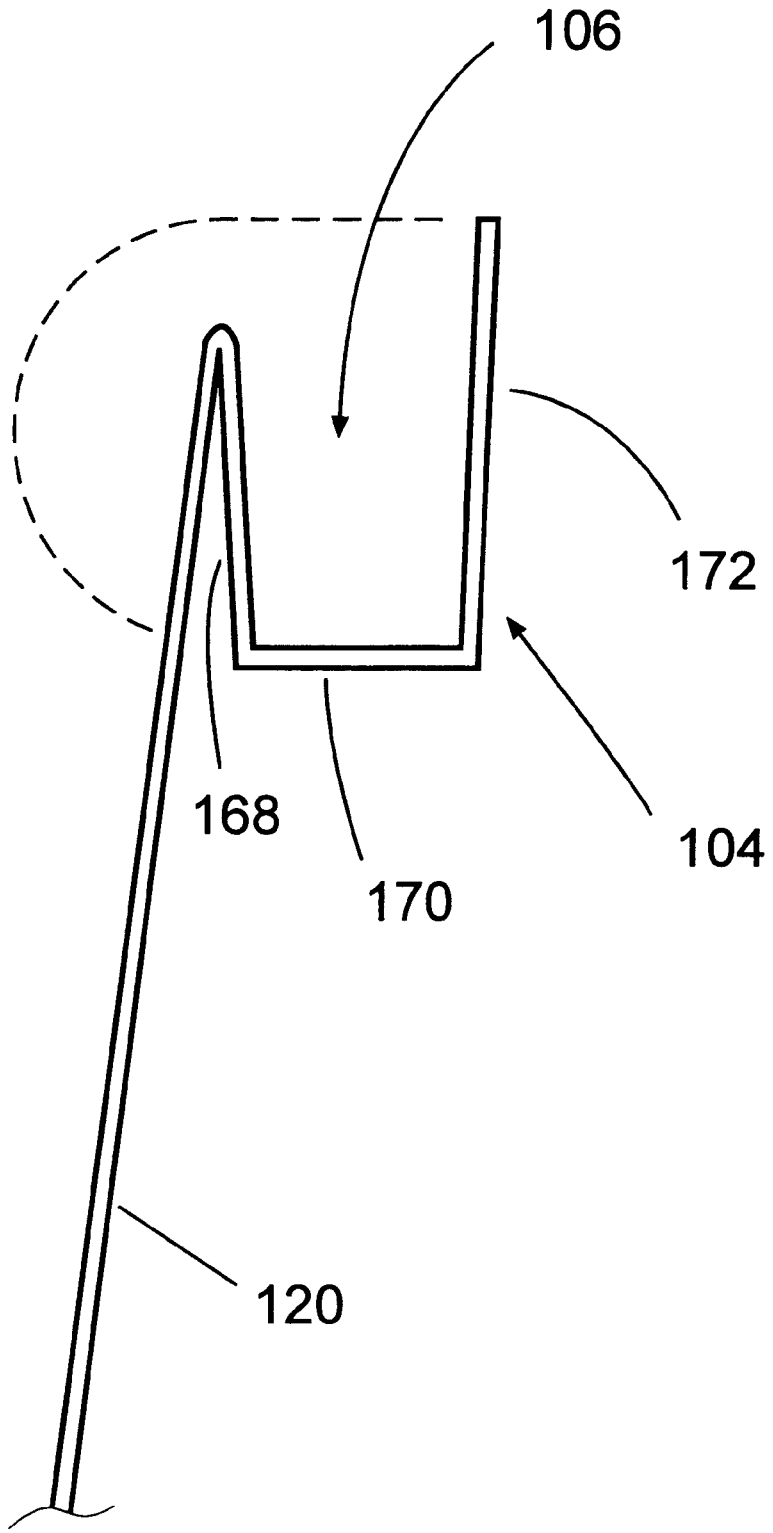
FIG. 12 is a cross sectional view, partially broken away, through the back wall of the collapsible, disposable food container of FIG. 6, during foldable assembly of the secondary body thereon.

As shown in FIGS. 6–7 & 12, the secondary body 104 is designed to be an optional feature provided on the container 110 for the convenience of a user thereof. The area of material 122 forming the secondary body 104, is left as an integral part of the back wall 120, after the container is folded and formed into an open, operable configuration. If a consumer desires to have a secondary body 104 for retaining condiments or for other reasons, the consumer merely needs to tear along the perforated lines 166, and then form the secondary body 104.

Referring particularly to FIG. 12, the secondary body 104 is formed by folding the area of material 122 down along the first fold line 160, such that the first subsection 168 is placed parallel with the back wall 120, then folding the second subsection 170 area of the material 122 perpendicularly out from the back wall 120 along the second fold line 162, and finally folding the third subsection 172 of the area of material 122 upwards, parallel to the back wall 120 along the third fold line 164. The secondary body 104 is retained by bending the outer sides of the third subsection 172 towards the back wall 120 and hooking the connecting slots 174 onto the receiving slots 176.

The Third Preferred Embodiment

Figure 13:
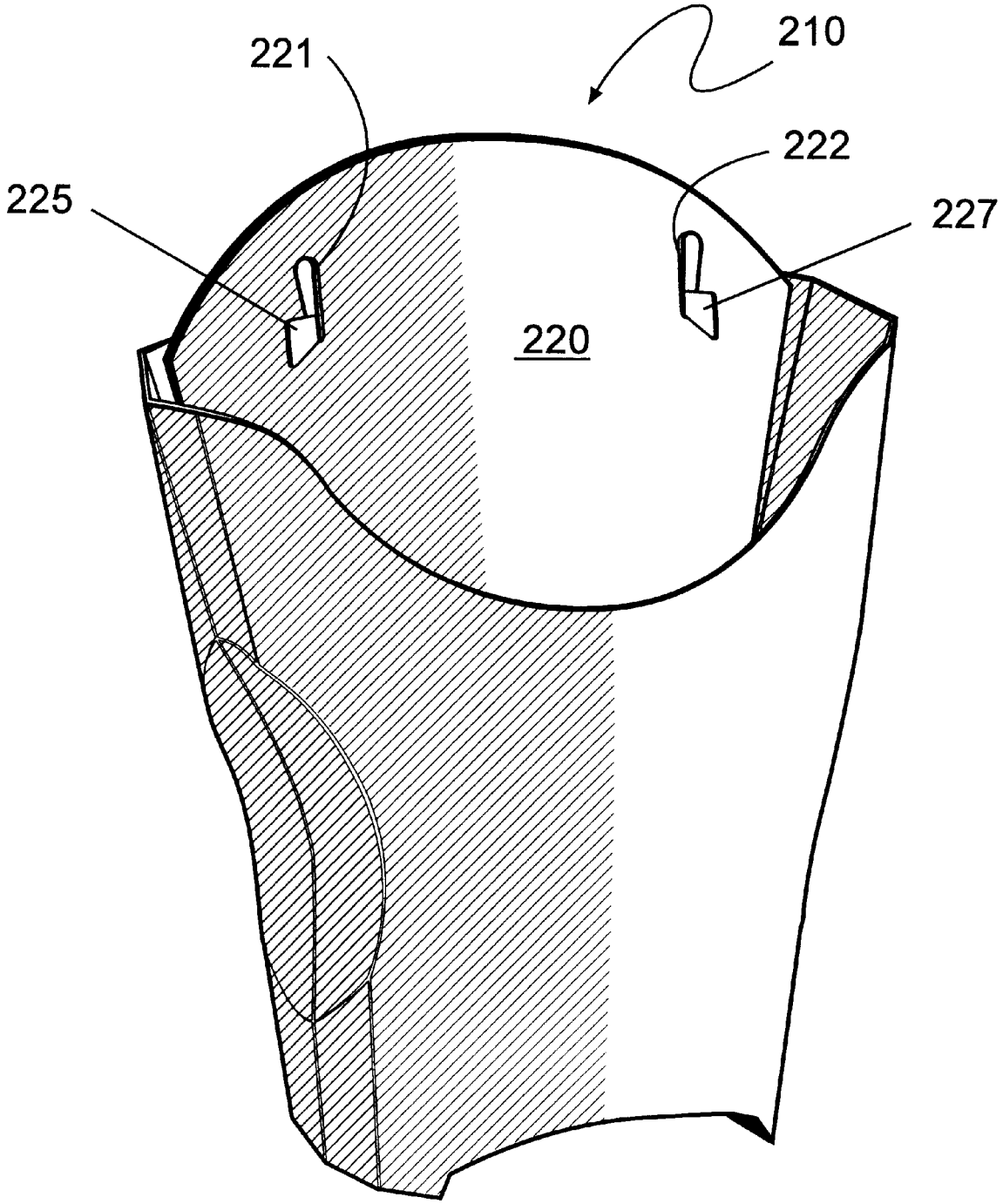
FIG. 13 is a front perspective view of a collapsible, disposable food container in accordance with a third preferred embodiment of the present invention.
Figure 14:
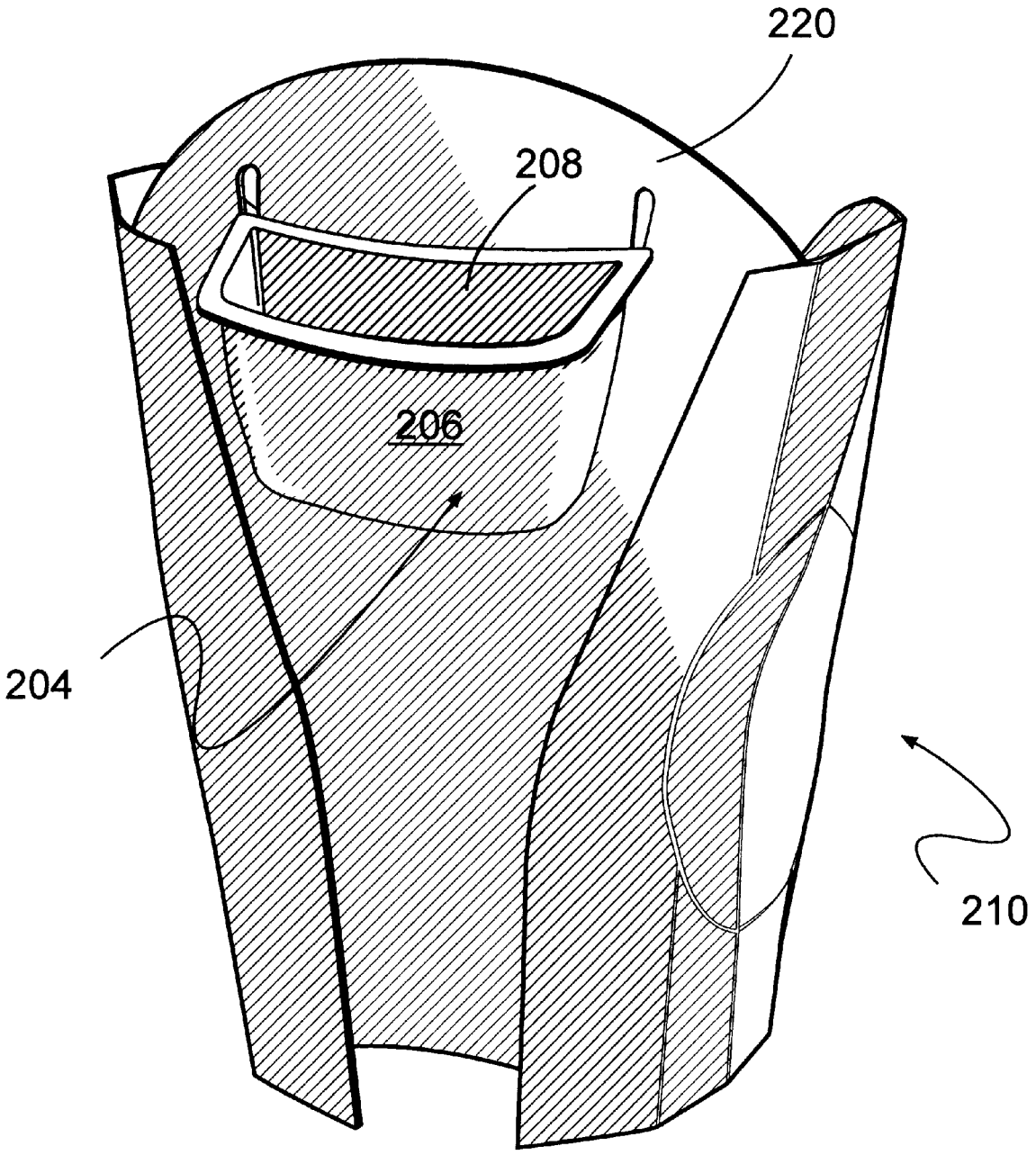
FIG. 14 is a rear perspective view of the food container of FIG. 13, also showing an auxiliary detachable condiment container thereon.
Figure 15:
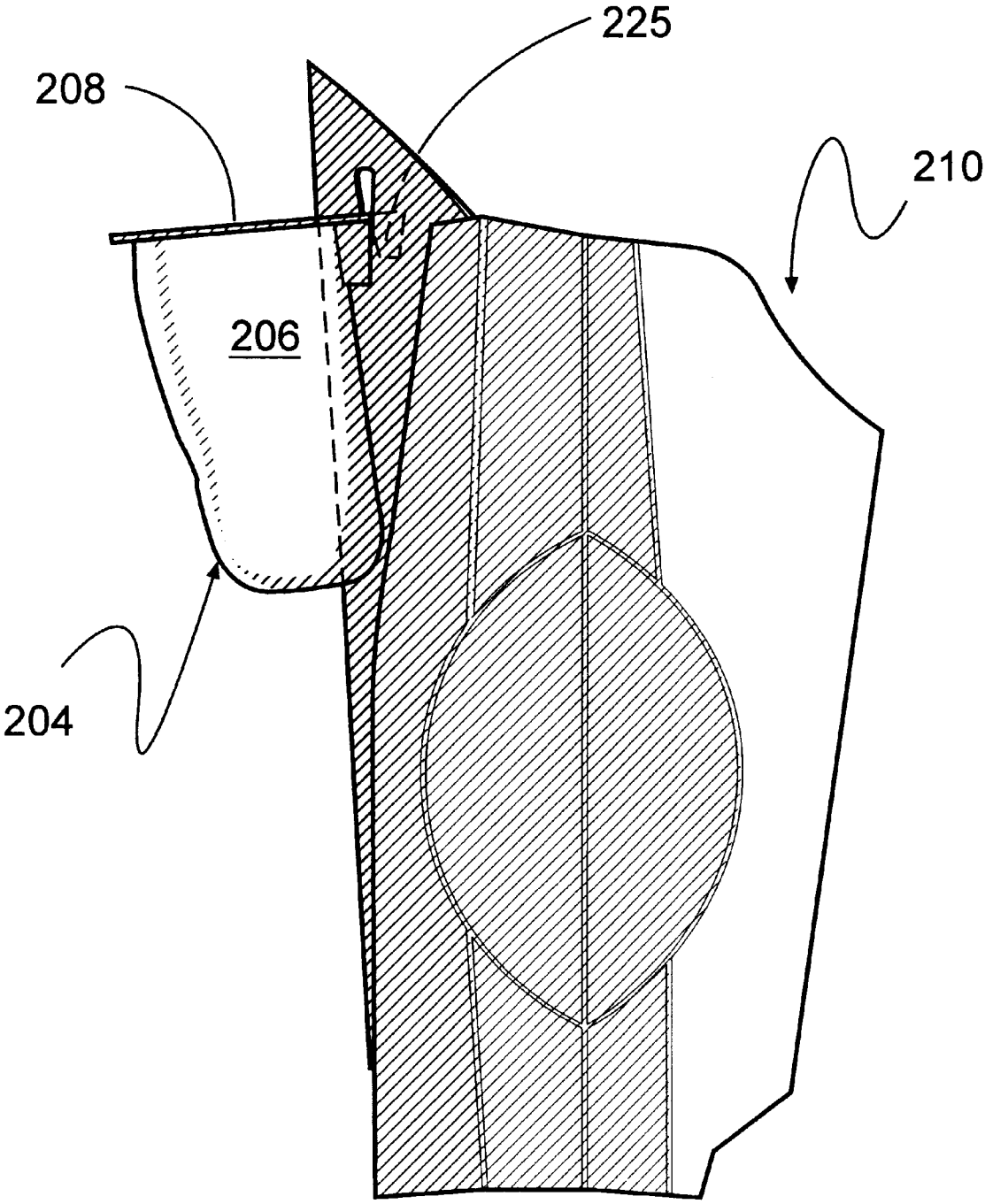
FIG. 15 is a side plan view of the food and condiment containers of FIGS. 13–14.

Referring to FIGS. 13–15, there is shown a collapsible, disposable food container 210 according to a third preferred embodiment. The third preferred embodiment is substantially similar to the first embodiment 10 as described herein, with the further modification that the container 210 according to this embodiment may, optionally, include a pair of spaced apart parallel vertical bracing slots 221, 222 formed in the back wall 220 thereof to supportively receive spaced apart wings 225, 227 of an alternative auxiliary condiment container 204. The wings 225, 227 are formed substantially in an inverted L-shape, and are preferably formed from strong plastic or from metal. Preferably, the alternative auxiliary condiment container 204 has a plastic blow-molded body 206 with a peelably removable foil lid 208 sealably attached thereto.

When the wings 225, 227 of the condiment container 204 are inserted into and through the bracing slots 221, 222 of the back wall from outside of the container 210, gravity and the structure of the wings 221, 222 will retentively keep the condiment container 204 in place thereon. Hanging placement of the alternative auxiliary condiment container 204 on to the outside of the back wall 220 of the container 210 does not inhibit or interfere with the ability of the container to fit into a beverage holder of a vehicle.

Although the present invention has been described herein with respect to preferred embodiments thereof, the foregoing descriptions are intended to be illustrative, and not restrictive. Those skilled in the art will realize that many modifications of the preferred embodiments could be made which would be operable. All such modifications which are within the scope of the claims are intended to be within the scope and spirit of the present invention.

We claim:

1. A collapsible, disposable food container, comprising a main body;

said main body being selectively adjustable between an operative, open position and a collapsed, flat position;

said main body being constructed from a unitary piece of flat stock material folded to define a front wall, a back wall, a pair of opposed side walls, and a bottom wall, wherein each of said side walls includes an upper portion, a middle portion and a lower portion, said middle portion of each side wall comprising an indentable gripping brace region;

wherein said front wall has a pair of opposed medial arcuate cutouts formed therein for supportively reinforcing the indentable gripping brace regions of the side walls; and wherein a lower portion of said main body is tapered, such that said container may be inserted in, and stably engage the walls of a circular opening, when said main body is in said operative position.

2. A collapsible food container as recited in claim 1, wherein said main body lower portion fits within a circular area in a range of 2.5 to 3 inches in diameter.

3. A collapsible food container as recited in claim 1, wherein each of said side walls includes a support leg which extends below said bottom wall when said main body is in its open position, for stably supporting said container on a flat surface.

4. A collapsible food container as recited in claim 3, wherein said container further includes overlapping panels extending from said side walls, respectively, and connected to portions of at least one of said front and back walls in an overlapping manner;

said overlapping panels also having support legs extending below said bottom wall to provide additional support for said container on a flat surface.

5. A collapsible food container as recited in claim 1, wherein said bottom wall includes:

a front section; and a rear section separated from said front section by a score line along which said bottom wall is collapsible;

said front and rear sections of the bottom wall being non-symmetric to each other.

6. A collapsible food container as recited in claim 5, wherein the distance between said back wall and said score line along said bottom wall is greater than the distance between said front wall and said score line along said bottom wall for further increasing stability of the container.

7. A collapsible, disposable food container, comprising:

a main body;

said main body being selectively adjustable between an operative, open position and a collapsed, flat position;

said main body being constructed of a unitary piece of flat stock material folded to define a front wall, a back wall, a pair of opposed side walls, and a bottom wall;

wherein each side wall includes an indentable gripping brace region, intermediate of upper and lower portions of the side wall;

said indentable gripping brace region flexing inwardly of the upper and lower portions of the side wall when inwardly directed pressure is applied thereto.

8. A collapsible food container as recited in claim 7, wherein each of said indentable gripping brace regions includes first and second convex side edges which intersect one another to define first and second end points.

9. A collapsible food container as recited in claim 7, wherein the indentable gripping brace regions and the lower portion of said main body fit within a circular area 2.75 inches in diameter.

10. A method of using a disposable container for foodstuffs, comprising the steps of:

a) pressing upwardly on a bottom wall of the container to bow it upwardly and form it into an outwardly concave shape;

b) pressing inwardly on two indentable gripping brace regions formed medially in opposite side walls of the container in a manner such that said gripping brace regions align with, and are reinforcingly supported by, opposed arcuate medial cutouts formed in a wall of the container which is substantially transverse to the side walls when the container is in an open position thereof; whereby the gripping brace regions temporarily and disengagably lock the container in said open position.

11. The method of claim 10, wherein each of the gripping brace regions of the container includes first and second convex side edges which intersect one another to define first and second end points.

* * * * *